US006015053A

United States Patent [19]

Sheng

[11] Patent Number: 6,015,053

[45] **Date of Patent: *Jan. 18, 2000**

[54] ALL-PLASTIC SHELF UNIT MODULE HAVING A SLIDING DRAWER

[75] Inventor: Tony L. Sheng, Livingston, N.J.

[73] Assignee: Honeyware, Inc., Kearny, N.J.

[ * ] Notice: This patent is subject to a terminal disclaimer.

[21] Appl. No.: 09/139,615

[22] Filed: Aug. 25, 1998

Related U.S. Application Data

[63] Continuation-in-part of application No. 29/076,783, Sep. 19, 1997, Pat. No. Des. 400,739.

[51] Int. Cl.[7] ..... A47B 88/04

[52] U.S. Cl. ..... 211/188; 211/186; 211/126.15; 211/119.003; 312/246; 312/334.23; 108/25; 108/26; 108/143

[58] Field of Search ..... 211/188, 126.5, 211/186, 126.15, 119.003, 133.1, 41.17; 312/246, 334.23; 108/25, 26, 143

[56] References Cited

U.S. PATENT DOCUMENTS

| | | | |
|---|---|---|---|
| 2,487,507 | 11/1949 | Zalkind | 315/398 |
| 2,689,778 | 9/1954 | Chambers et al. | 312/334.23 X |
| 2,695,831 | 11/1954 | Sigal | 312/246 X |
| 2,801,146 | 7/1957 | Mikulas | 312/334.23 X |
| 3,169,813 | 2/1965 | Cannon et al. | 211/126.15 |
| 3,275,396 | 9/1966 | Hillson et al. | 312/246 |
| 4,140,355 | 2/1979 | Swain | 312/334.23 X |
| 4,317,523 | 3/1982 | Konstant et al. | 211/187 |
| 4,628,185 | 12/1986 | Norwood et al. | 312/246 X |
| 4,688,148 | 8/1987 | Mallory et al. | 211/41.17 X |
| 4,735,470 | 4/1988 | Falk | 312/246 |
| 4,861,277 | 8/1989 | Bina | 211/41.17 X |
| 4,936,641 | 6/1990 | Bussan et al. | 211/134 X |
| 4,944,566 | 7/1990 | Carper | 312/246 X |
| 4,976,358 | 12/1990 | Stickel et al. | 211/41.17 |
| 5,158,187 | 10/1992 | Taub | 211/186 |
| 5,168,431 | 12/1992 | Moulton et al. | 211/41.17 X |
| 5,191,514 | 3/1993 | Kabat et al. | 211/41.17 X |
| 5,215,362 | 6/1993 | Zoellner | 312/246 |
| 5,244,272 | 9/1993 | Thompson | 312/334.23 X |
| 5,253,774 | 10/1993 | Honig et al. | 211/126.15 X |
| 5,432,682 | 7/1995 | Giehl et al. | 211/41.17 X |
| 5,641,217 | 6/1997 | Caruso et al. | 312/334.23 X |
| 5,738,226 | 4/1998 | Dean | 211/41.17 |

*Primary Examiner*—Daniel P. Stodola
*Assistant Examiner*—Khoa Tran

[57] ABSTRACT

An all-plastic shelf unit module has a sliding drawer supported below its underside. The module has four pieces: a drawer, a shelf piece, and two slide supports that support the drawer beneath the shelf piece. The slide supports have intromittent plugs that plug into sockets located on the bottom surface of the shelf piece. The plugs have a "lock in place" feature that locks them in place once they have been fully inserted, and such insertion is accomplished by horizontal motion.

7 Claims, 7 Drawing Sheets

ALL-PLASTIC SHELF UNIT MODULE HAVING A SLIDING DRAWER

CROSS-REFERENCE TO RELATED APPLICATION

This is a continuation-in-part of commonly-owned U.S. patent application Ser. No. 29/076,783 filed Sep. 19, 1997, now U.S. Pat. No. Des. 400,739. The entire disclosure of this allowed patent application is hereby incorporated herein as if fully set forth.

BACKGROUND OF THE INVENTION

The invention relates to shelf units, and more particularly relates to light duty shelf units such as are sold for home use. In its most immediate sense, the invention relates to a module used in such all-plastic shelf units.

A shelf unit is a self-supporting structure having a plurality of shelves (typically, three to six shelves). Light duty shelf units are typically purchased by homeowners for use in the basement, garage etc.

Conventionally, light duty all-plastic shelf units are sold in mass-merchant outlets in an unassembled state. To use the shelf unit, the end user must take it out of the box and assemble it. Hence, to be commercially successful, such units must not only be inexpensive but must also be easy to assemble.

It is difficult to satisfy these design requirements when the shelf unit is to be provided with sliding drawers that are to be supported below the shelves. Such a drawer must remain attached to its shelf, and must remain slidable, even when heavily loaded. This requires that the connection between the drawer and the shelf be robust. Furthermore, this must be accomplished using the minimum quantity of material (to reduce recurring manufacturing cost), using the minimum number of pieces (to reduce assembly effort by the end user), and using a relatively inexpensive mold with a fast cycle time (to reduce tooling cost).

It would therefore be advantageous to provide an inexpensive all-plastic module for use in a shelf unit, whereby a drawer could be easily and securely attached beneath a shelf.

Therefore, one object of the invention is to provide an inexpensive all-plastic module for use in a shelf unit, whereby a drawer could be easily and securely attached beneath a shelf.

Another object is, in general, to improve on modules and shelf units of this general type.

In accordance with the invention, an all-plastic module has four plastic pieces: a drawer, two slide supports, and a shelf piece. The drawer is open-topped and rectangular and has two elongated slide pieces, each being attached to the top edge of a corresponding side of the drawer and extending horizontally outwardly therefrom. Each of the two slide supports has an elongated recess dimensioned to receive a corresponding one of the slide pieces.

Each of the slide supports also has at least one intromittent plug. Each plug mates with a corresponding socket located on the bottom surface of the shelf piece, and is introduced therein by horizontal motion (i.e. motion parallel to the surface of the shelf piece). When the slide supports have been attached to the shelf piece by introducing the plugs into the sockets therein, the slide supports form tracks in which the slide pieces can move. Additionally, because the pieces are designed so that the plugs are introduced into the sockets by horizontal motion rather than vertical motion, loading the drawers does not tend to urge the plugs out of the sockets.

Advantageously, and in the preferred embodiment, the shelf piece is perforated, with one perforation being located at each of the sockets and being surrounded thereby. As will be seen below, this design makes it possible to produce the shelf piece using an economical mold with a rapid cycle time. And, this design also makes it possible to provide the slide supports with a "lock in place" feature, wherein the plugs are provided with a deformable key having an enlarged head. While a plug is being introduced into a socket, the key compresses. Once the plug has been fully introduced into the socket, the key expands and the head fits into the perforation, locking the plug in place.

BRIEF DESCRIPTION OF THE DRAWINGS

The invention will be better understood with reference to the following illustrative and non-limiting drawings, in which.

DETAILED DESCRIPTION OF PREFERRED EMBODIMENTS

In all the drawings, each element is always indicated by the same reference number.

Figure 1:
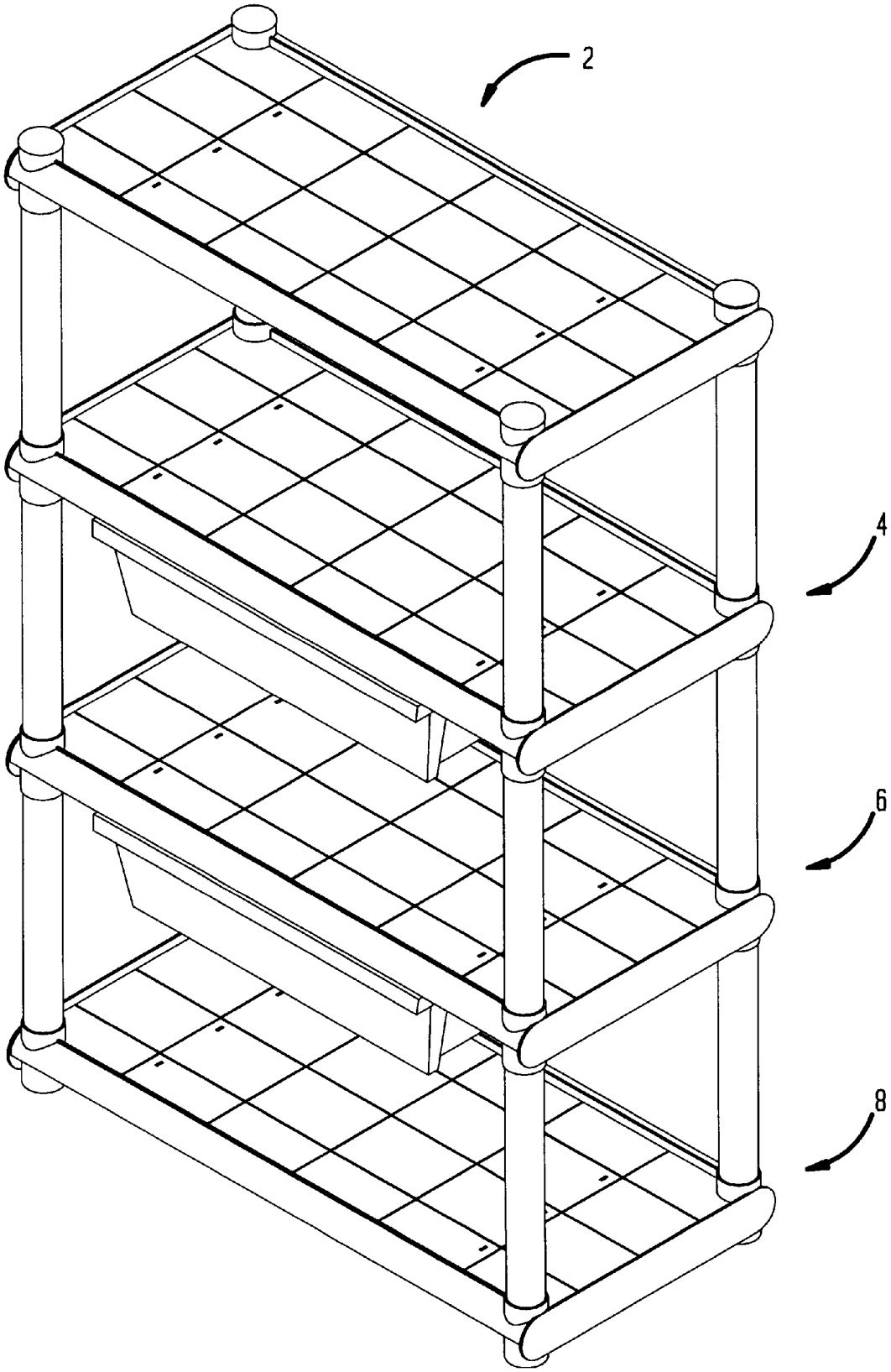
FIG. 1 is a perspective drawing of a shelf unit incorporating two modules in accordance with the preferred embodiment of the invention.

In a conventional shelf unit such as is shown in FIG. 1, a plurality of shelves generally indicated in by reference numbers 2, 4, 6 and 8 are supported one above the other to form a free-standing unit. As is also shown in FIG. 1, two of the shelves 4 and 6 support slide-out drawers.

As will become apparent below, the preferred embodiment of the invention relates to the two center shelves 4 and 6 shown in FIG. 1. The invention is a module, and the number of modules contained in any particular shelf unit is not a part of the invention.

Figure 2:
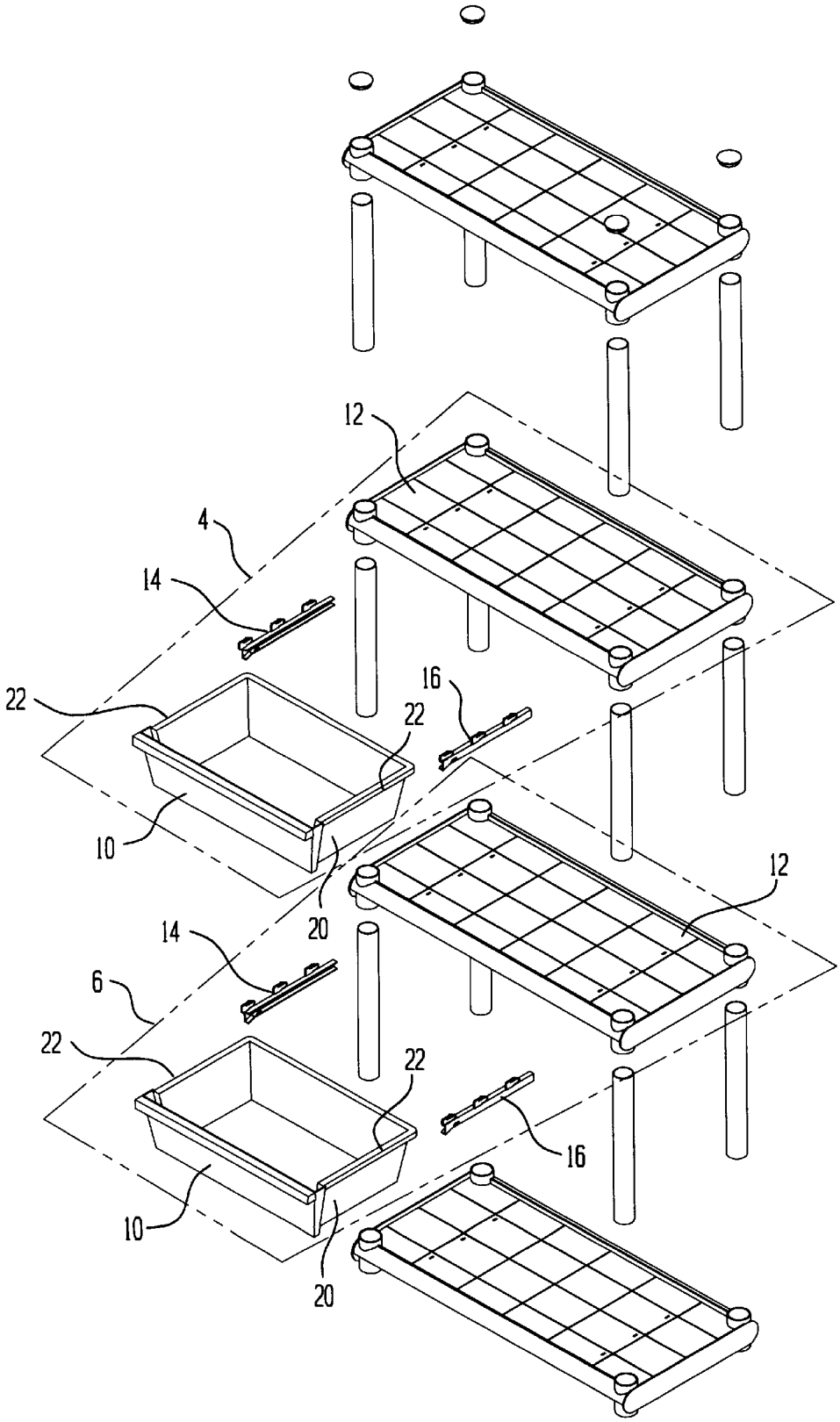
FIG. 2 is an exploded view of the shelf unit shown in FIG. 1.

Turning now to FIG. 2, it can be seen that each of the modules 4, 6 shown in FIG. 1 is made up of four pieces: a drawer 10, a shelf piece 12, and two shelf supports 14 and 16. The drawer 10 will be described first, the shelf piece 12 will be described next, and the shelf support 16 will be described afterward. (The shelf support 14 is a mirror image of the shelf support 16, and for that reason will not be specifically described.) In accordance with the preferred embodiment, all the pieces are injection molded for economy, and are advantageously made of high-impact polystyrene. Polystyrene is used because it has a better appearance, but this is not required; another plastic may be used instead.

The drawer 10 is a unitary part. The drawer 10 has two sides 20, and also has slides 22 that are located at the top edges of the sides 20. These slides 22 are the parts of the drawer 10 by which the drawer 10 is supported below its corresponding shelf piece 12 and, as will be seen below, allow the drawer 10 to slide in and out beneath the shelf piece 12.

The shelf piece 12 is also a unitary part. As is conventional in the art of all-plastic shelf units, the shelf piece 12 has a top surface 23 and a bottom surface 24. The shelf piece 12 has a pattern of ribs 26 on its bottom surface to reinforce it and prevent it from bending when articles are put on the top surface 23. Although in this example the ribs 26 are arranged in a rectangular pattern with some diagonally extending braces (see FIG. 3B), this is not a part of the invention. Any suitable pattern of ribs 26 may be used.

Figure 3A:
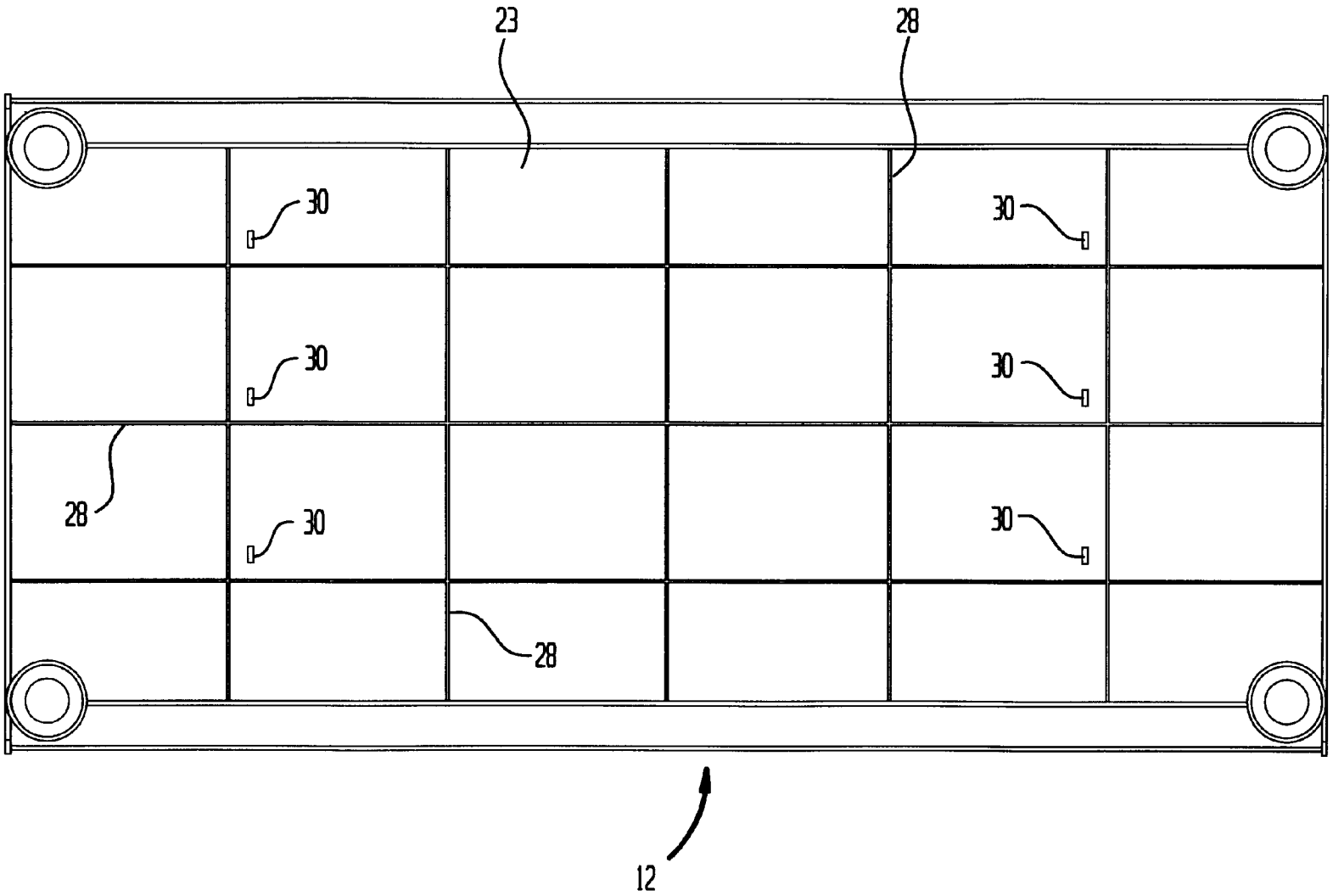
FIGS. 3A and 3B are top and bottom views of a shelf piece in accordance with the preferred embodiment of the invention.
Figure 3B:
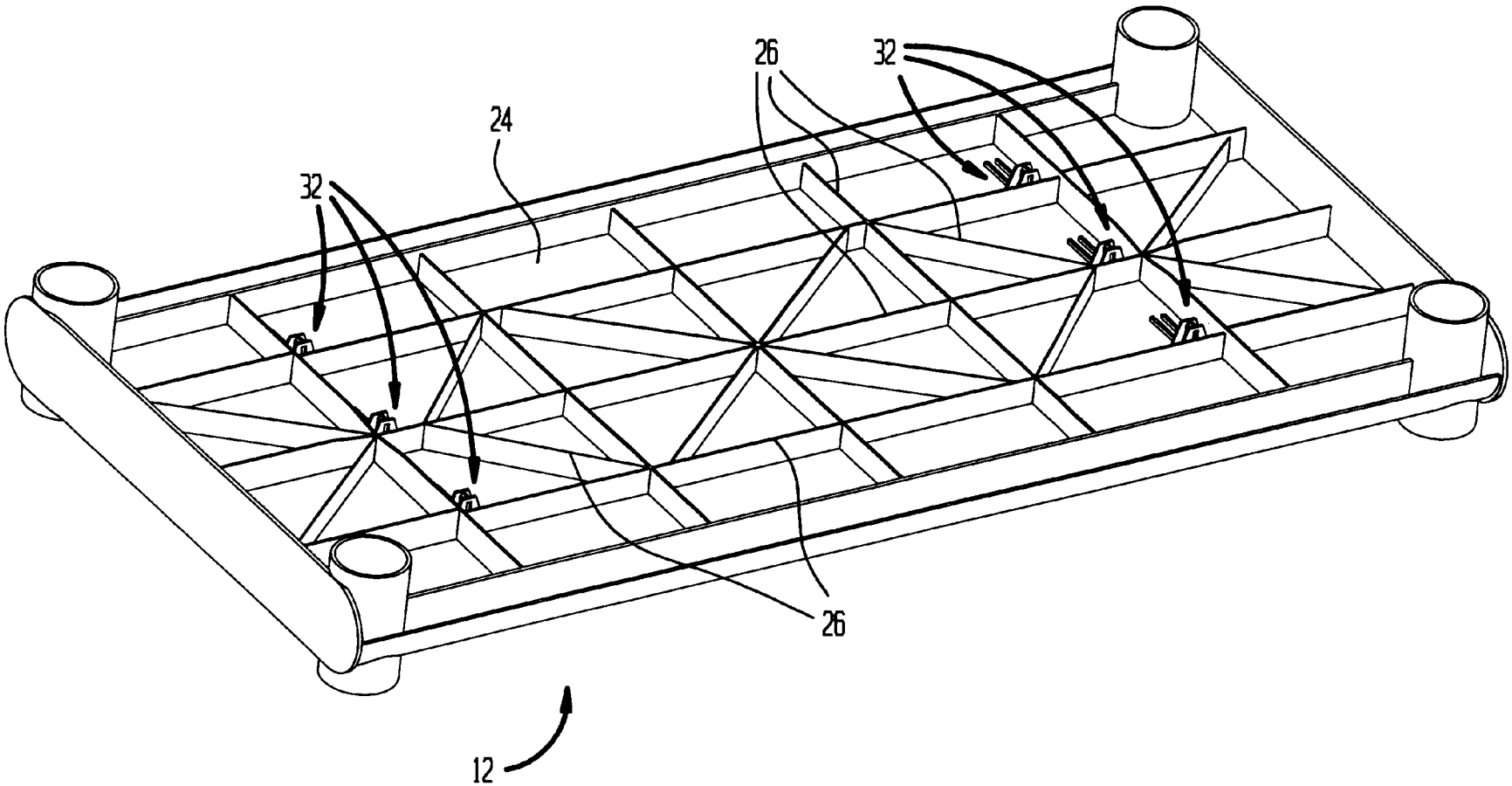

As can be seen in FIG. 3A, the top surface 23 has a rectangular pattern of lines 28. The lines 28 are created by the surface finish on the top surface 28 of the shelf piece 12 (i.e. they may be grooves, or may be smooth areas between rectangular pebbled regions). The lines 28 serve only to conceal "sink marks" that are necessary artifacts of the injection-molding process. Such "sink marks" appear everywhere two plastic surfaces intersect.

In accordance with the preferred embodiment, the shelf piece 12 has six rectangular perforations 30. As will be described in more detail below, this is because six sockets 32 are mounted on the bottom surface 24. However, the number of perforations 30 is not a part of the invention; there may be more or fewer, depending upon the application. Likewise in accordance with the preferred embodiment, the perforations 30 are arranged in two parallel lines of three each. This is because in accordance with the preferred embodiment, each of the slide supports 14 and 16 has three plugs 52. However, the arrangement of the perforations 30 is not a part of the invention.

Figure 4:
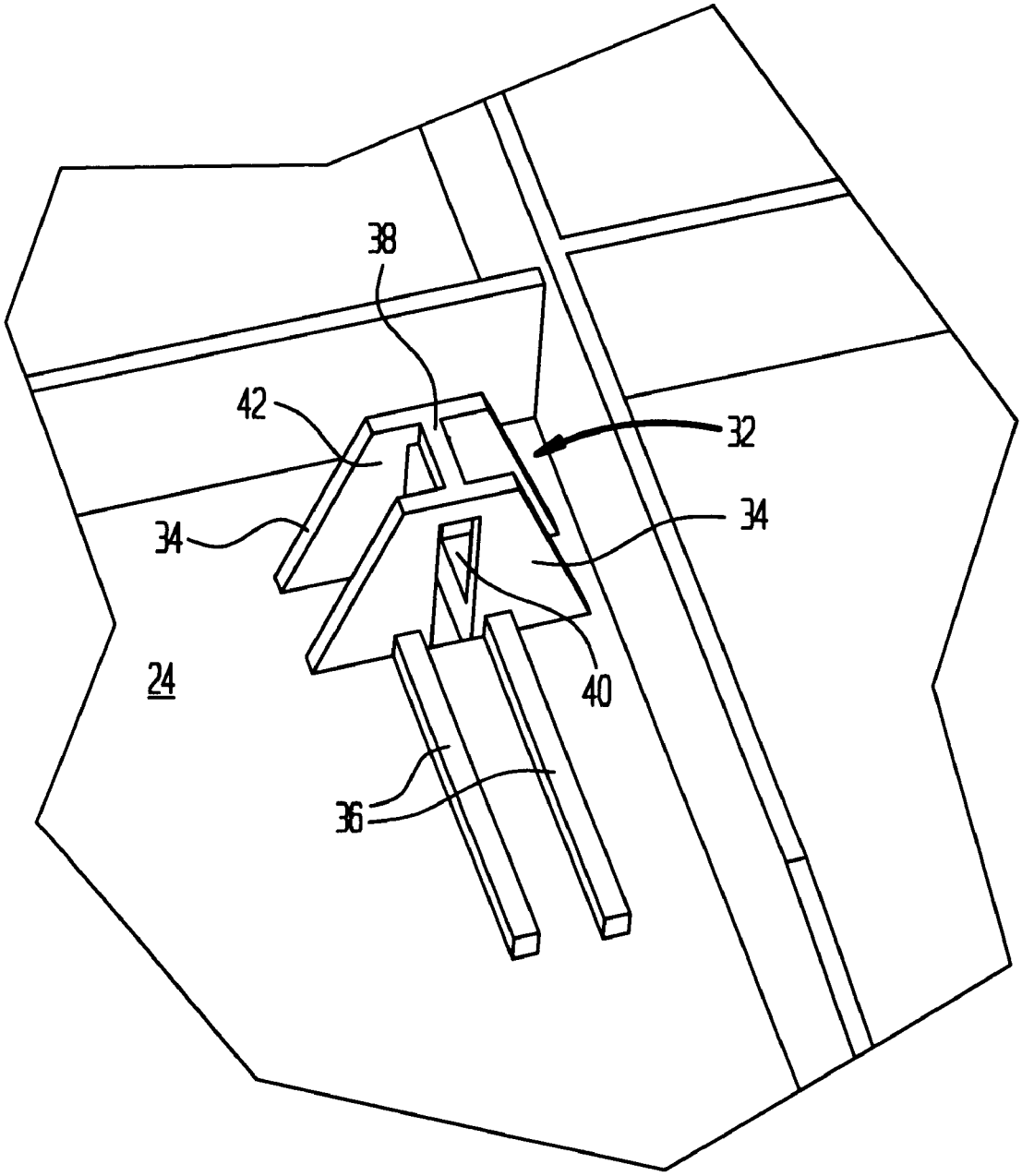
FIG. 4 is a detail view of a socket in accordance with the preferred embodiment of the invention.
Figure 5B:
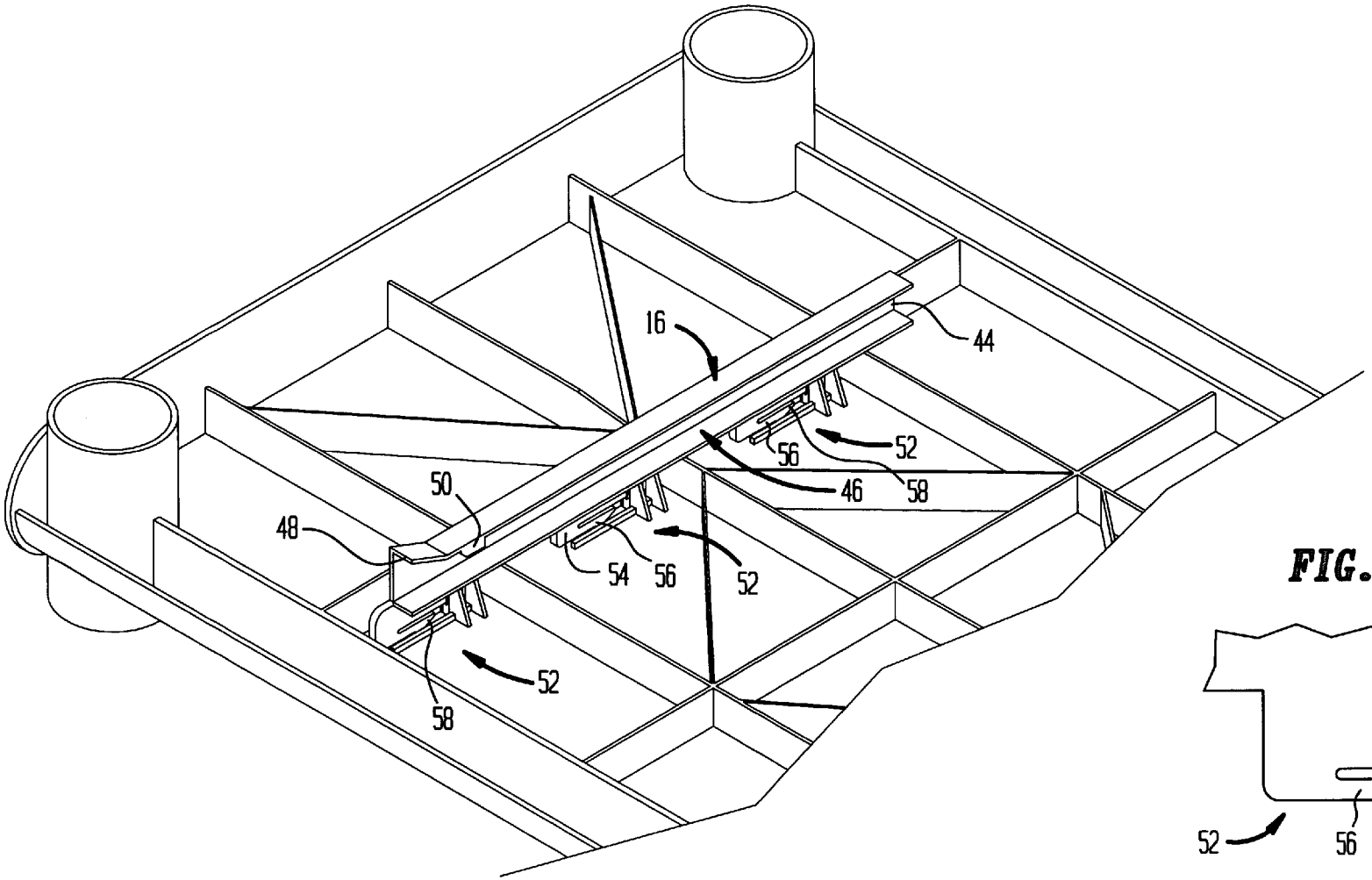
FIG. 5B is a detail inverted view of a slide support in accordance with the preferred embodiment of the invention, just before being attached to the shelf piece (which is shown upside down)
Figure 5A:
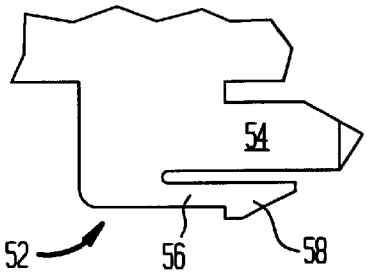
FIG. 5A is a detail view of a plug in accordance with the preferred embodiment of the invention.

Turning now to FIG. 4, a single socket 32 is illustrated in detail. In the preferred embodiment, there is one socket 32 for each of the perforations 30. Each socket 32 is located on the bottom surface 24. As will be seen below, each socket 32 is designed to receive a plug 52 that is inserted horizontally.

Each socket 32 is an integral part of the shelf piece 12. Each socket 32 has two triangular standards 34, two parallel tracks 36, and a crosspiece 38 that connects the standards 34 together to form an H as viewed from the top, with the standards 34 forming the sides of the H and the crosspiece 38 forming the bar of the H. In each socket 32, the corresponding perforation 30 is located between the standards 34 and between the ends of the tracks 36. The standards 34 have generally rectangular openings 40 that are aligned with each other, and the standards 34 are thickened at regions 42 adjacent the openings 40 to reinforce the sockets 32 against breakage.

Although the operation of the socket 32 will be discussed in more detail below, it is important to note that the use of the perforations 30 makes it possible to substantially reduce the cost of producing the shelf pieces 12. There are two reasons for this. The first is that the sockets 32 can be produced using a relatively inexpensive mold, and the second is that such a mold can operate more quickly and more parts can be produced per unit time.

If the perforations 30 were not present, it would be necessary to form the openings 40 by providing one of the mold halves with moveable elements, injecting the polystyrene while one of those elements fills up each void where the openings 40 are to be produced, and subsequently producing the openings 40 by sliding the elements out once the polystyrene has set (this is referred to in the art as "cam action"). By using such a molding technique, the mold would require additional moving parts that would greatly increase its cost and would (because of the time required to move the elements back and forth) increase the cycle time required to produce each shelf piece 12. By using the perforations 30, the openings 40 can be produced using a so-called "offset method", in which a) one mold half has first elements (not shown) that extend through each of the perforations 30 when the mold is closed and b) the other mold half has mating second elements (not shown) that are immediately adjacent the first elements when the mold is closed but that do not extend through the shelf piece 12. (The "offset method" is well known to persons skilled in the art.)

As will be discussed in more detail below, when a plug 52 is introduced into one of the sockets 32, the plug 52 deforms because the openings 40 are slightly smaller than the overall size of the plug 52. Once the plug 52 has been completely introduced into the openings 40, the plug 52 regains its original shape and the head of the plug 52 drops into the perforation 30. And, when the drawer 10 is loaded, the socket 32 retains the plug 52 between the standards 34 because the cross piece 38 keeps the standards 34 connected together and the regions 42 reinforce the standards 34 against breakage.

The slide support 16 is a unitary piece. The slide support 16 has an elongated beam 44 that is U-shaped in cross-section to form a horizontally elongated recess 46. (This recess 46 serves as a track to entrain one of the slides 22.)

At its forward end 48, the beam 44 is enlarged to make it easier to insert the slide 22 therein. The beam 44 also has a stop 50 that projects into the recess 46 adjacent to the forward and 48. This stop 50 prevents the slide 22 from being pulled out of the slide support 16 when the drawer 10 is opened.

The slide support 16 also has three intromittent plugs, each generally indicated by reference number 52. Each of the plugs 52 is divided into two portions: a rigid portion 54 and a deformable key 56 having an enlarged head 58. The rigid portion 54 and the key 56 are horizontally elongated, with the rigid portion 54 being parallel to and spaced from the beam 44. The key 56 is above the rigid portion 54 and the total distance between the top of the head 58 and the bottom of the rigid portion 54 is slightly larger than the height of the openings 40.

When a slide support 16 is to be attached to the shelf piece 12, the keys 56 and the heads 58 of the plugs 52 are placed between the tracks 36 (which make it easier to position the plugs 52 relative to the sockets 32). Then, the slide support 16 is moved horizontally so that the rigid portions 54 enter the openings 40.

The distal end of each rigid portion 54 has a small notch that makes it easy for the distal end of the rigid portion 54 to enter the first opening 40 in the first standard 34. As the slide support 16 moves horizontally, the bottom edge of the rigid portion 54 is pushed up by the crosspiece 38, causing the head 58 to be pressed against the bottom surface 24 and thereby causing the key 56 to be compressed toward the rigid portion 54. As horizontal motion continues, the head 58 enters into the perforation 30, where the head 58 pops up and locks in. This locks the slide support 16 in position into the shelf piece 12, from which the slide support 16 cannot be removed without pushing all the heads 58 downwardly through the perforations 30.

Figure 6:
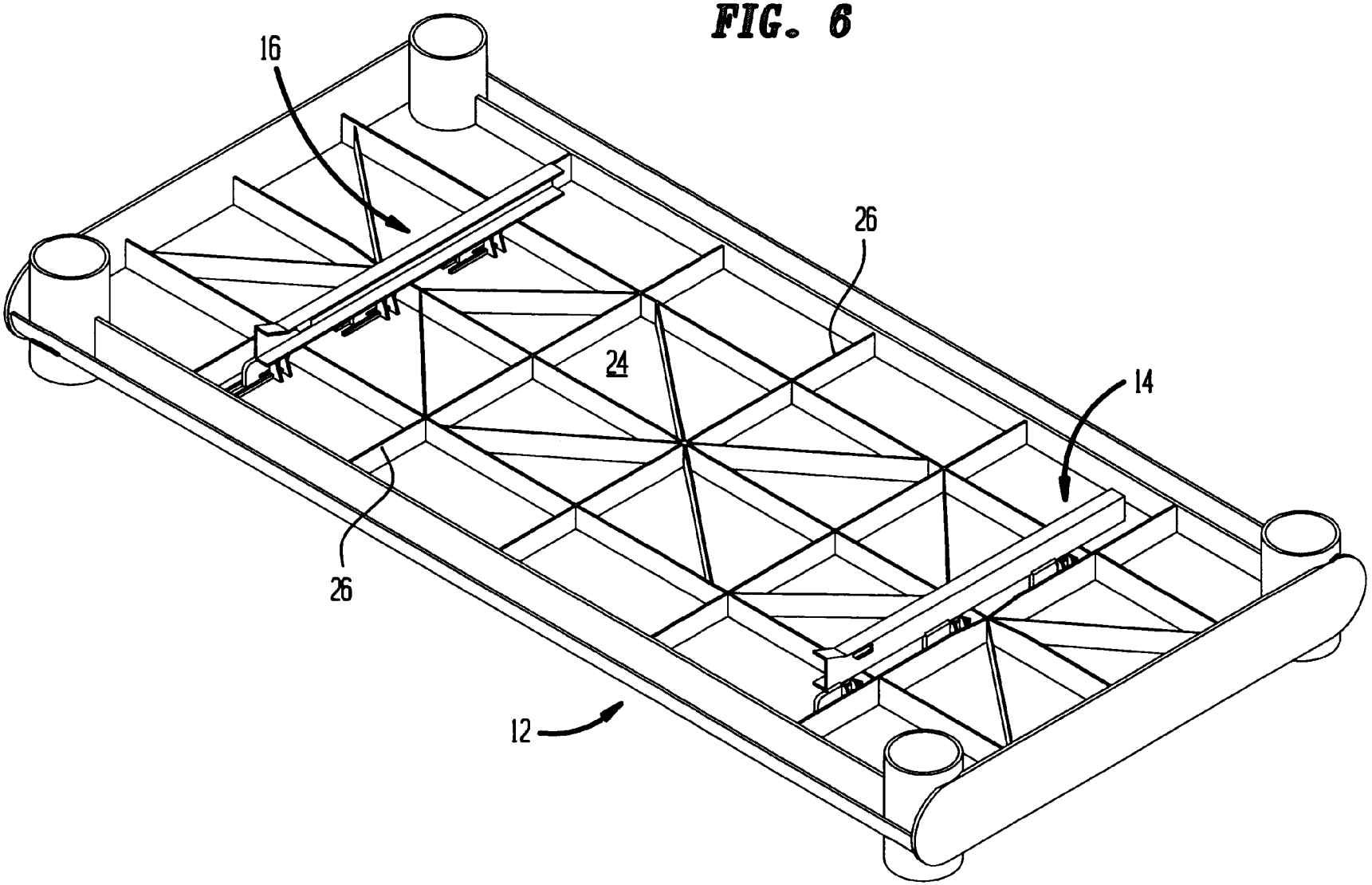
FIG. 6 is an inverted view showing the two slide supports attached to a shelf piece (which is shown upside down) in accordance with the preferred embodiment of the invention.

As can be seen from FIG. 6, the slide supports 14 and 16 are attached to the shelf piece 12 in such a manner that the slides 22 can be inserted therein to support the drawer 10 below the shelf piece 12.

Although at least one preferred embodiment of the invention has been described above, this description is not limiting and is only exemplary. The scope of the invention is defined only by the claims, which follow:

I claim:

1. An all-plastic shelf unit module with a sliding drawer supported below its underside, comprising:

an open-topped rectangular plastic drawer having two parallel side pieces and two parallel, horizontally elongated slide pieces, each slide piece being located at the top edge of a corresponding one of the side pieces and extending horizontally outwardly therefrom;

two plastic slide supports, each having an elongated recess dimensioned to receive a corresponding one of the slide pieces and further having at least one integrally formed intromittent plug located on its top, each of said at least one plug being elongated parallel to the recess in its slide support; and a plastic shelf piece having horizontal top and bottom surfaces and a plurality of integrally formed sockets extending downwardly from the bottom surface, the sockets being dimensioned to receive the plugs of the slide supports when the plugs are introduced therein by horizontal motion and being located in such a manner that when the plugs are received within the sockets, the slide supports are mounted under the bottom surface with the recesses being horizontal, parallel to each other, and facing each other, the recesses being so spaced apart from each other as to slidably receive the slides and thereby support the drawer beneath the bottom of the shelf piece and between the slide supports.

2. The module of claim 1, wherein each plug includes a deformable key that compresses during insertion of the plug into the socket and that expands after the plug has been fully inserted therein, thereby preventing withdrawal of the plug.

3. The module of claim 1, wherein the plastic shelf piece has as many perforations as it has sockets, each perforation extending through the top and bottom surfaces and being located at a corresponding one of the sockets.

4. The module of claim 1, wherein the plastic is polystyrene.

5. An all-plastic shelf unit module with a sliding drawer supported thereunder, comprising:

an open-topped rectangular plastic drawer having two parallel side pieces and two parallel, horizontally elongated slide pieces, each slide piece being located at the top edge of a corresponding one of the side pieces and extending horizontally outwardly therefrom;

two plastic slide supports, each having an elongated recess dimensioned to receive a corresponding one of the slide pieces and further having at least one integrally formed intromittent plug located on its top, each of said at least one plug being elongated parallel to the recess in its slide support and being divided into a rigid portion and a deformable key having an enlarged head; and a plastic shelf piece having a horizontal top surface, a ribbed bottom surface, a plurality of perforations extending between the top and bottom surfaces, and a plurality of integrally formed sockets located between the ribs and extending downwardly from the bottom surface, each socket surrounding a corresponding one of the perforations, being dimensioned to receive a plug of a slide support, and being located in such a manner that when the plugs are received within the sockets when the plugs are introduced therein by horizontal motion, the slide supports are mounted under the bottom surface with the recesses being horizontal, parallel to each other, facing each other, and so spaced apart from each other as to slidably receive the slides and thereby support the drawer beneath the bottom of the shelf piece and between the slide supports, and each socket being so dimensioned that when a plug is being introduced therein, the key is compressed until the plug has been completely introduced therein, whereupon the head of the key is located within the corresponding perforation and the key is restored to its original shape.

6. The module of claim 5, wherein a guide channel is located adjacent each socket, the guide channel being dimensioned to guide a one of said at least one plug into the socket.

7. The module of claim 5, wherein each slide support has three plugs.

* * * * *